US008833002B2

(12) United States Patent
Lack, Jr.

(10) Patent No.: US 8,833,002 B2
(45) Date of Patent: Sep. 16, 2014

(54) CELL FRONT PANEL SYSTEM

(71) Applicant: William Vollis Lack, Jr., Ocean Springs, MS (US)

(72) Inventor: William Vollis Lack, Jr., Ocean Springs, MS (US)

( * ) Notice: Subject to any disclaimer, the term of this patent is extended or adjusted under 35 U.S.C. 154(b) by 0 days.

(21) Appl. No.: 13/678,506

(22) Filed: Nov. 15, 2012

(65) Prior Publication Data

US 2013/0118096 A1 May 16, 2013

Related U.S. Application Data

(60) Provisional application No. 61/629,214, filed on Nov. 15, 2011.

(51) Int. Cl.

| | |
|---|---|
| ***E04H 3/06*** | (2006.01) |
| ***E04B 1/38*** | (2006.01) |
| ***E04H 3/08*** | (2006.01) |
| *E04B 2/74* | (2006.01) |
| *E04B 2/82* | (2006.01) |

(52) U.S. Cl.

CPC ..... *E04H 3/08* (2013.01); *E04B 2/7448* (2013.01); *E04B 1/38* (2013.01); *E04B 2/828* (2013.01)

USPC ..... 52/106; 52/79.9; 52/202; 52/220.1; 52/284; 52/741.3

(58) Field of Classification Search

CPC ..... E04H 3/08; E04B 1/38; E04B 2/828; E04B 2/7448; E04B 2/90; E06B 9/01

USPC ..... 52/106, 235, 284, 745.01, 79.1, 202, 52/741.3, 220.1, 220.2

See application file for complete search history.

(56) References Cited

U.S. PATENT DOCUMENTS

| | | | | |
|---|---|---|---|---|
| 2,893,067 | A * | 7/1959 | Meek | 52/580 |
| 2,927,665 | A * | 3/1960 | Hauf | 52/262 |
| 4,843,788 | A * | 7/1989 | Gavin et al. | 52/205 |
| 5,400,553 | A | 3/1995 | Brennan | |
| 6,151,852 | A * | 11/2000 | Linn et al. | 52/239 |
| 6,415,557 | B1 * | 7/2002 | McCalley | 52/79.1 |
| 7,318,300 | B1 * | 1/2008 | Seavy | 52/106 |

* cited by examiner

*Primary Examiner* — Brian Glessner
*Assistant Examiner* — Brian D Mattei
(74) *Attorney, Agent, or Firm* — Butler Snow, LLP

(57) ABSTRACT

I disclose a design and method for constructing and installing a cell front panel system that simplifies the design, construction and installation of secure jail, prison, containment or detainment cell fronts. This design and method allows for construction and installation of cell fronts to occur at any time during a facility construction, using only small hand tools and non-specialized workers.

14 Claims, 18 Drawing Sheets

Replacement Sheet

6/18

CELL FRONT PANEL SYSTEM

CROSS-REFERENCES TO RELATED APPLICATIONS

This application claims the benefit of U.S. Provisional Application No. 61/629,214 filed Nov. 15, 2011 and is herein incorporated by reference in its entirety.

FIELD OF THE INVENTION

The present invention is generally directed toward the design, construction and installation of a cell front panel system.

BACKGROUND OF THE INVENTION

This invention arises as a result of the ubiquitous societal need to increase the size and number of available cells for short term and long term detainment and correctional facilities in order to accommodate the ever growing population of people behind bars. Currently, by and large, detainment and correctional facilities of all genres suffer overcrowded inmate populations residing under conditions that often compromise health and safety and fail to provide even a scintilla of dignity to the incarcerated no matter how egregious the event was that placed the inmate there. Many facilities, and the individual cells within those facilities, are in need of rehabilitation, enlarging and/or reconstruction; and with the ever increasing inmate population, there is an even greater demand for new facilities with more cells. All levels of government that are in charge of correctional and detainment facilities are falling well short of obvious their responsibilities.

The industry has continuously tried to improve the traditional methods of building prisons with concerns focused on construction time, design and cost. Traditional methods of design, construction and installation of modern correctional facility cells resulted in scheduling challenges and delays. These methods required one of two slow and cumbersome processes: either on-site welding for construction and installation; or off-site construction, then installation using large cranes to lower the cells through an open roof. The cell fronts in traditional methods also required installation early in the process. This prevented the scheduling of other construction critical items such as the roof, multi-level floors, electrical, plumbing and air conditioning systems, which were all dependent on the cell front being in place. The traditional methods for building cell fronts were also slow due to on demand manufacturing with long delivery time frames. All of these flaws resulted in an overall lengthy, uncertain and costly facility construction process.

Traditional cell fronts that were constructed off-site also had further flaws, including they did not allow for tolerances that vary in leveling, plumbness and dimensions. This could result is the need for significant on-site modifications. The size of the cell front would prohibit its use in restoration projects unless those projects where specifically designed to accommodate the cell front. Furthermore, the design of these cells would make installation virtually impossible unless the second floor was installed after lower level cell fronts were installed. This is so because most modern correctional facilities today have housing units that have cells around the perimeter of a dayroom with a second level mezzanine of cells. The second level walkway is an extension of the ceiling of the lower level cell and second level floor. This is usually at a height of 8' with cell front fitting tight against floors. Installation of a cell front on the first floor after installation of the second floor would be extremely cumbersome if not completely impractical.

SUMMARY OF THE INVENTION

I disclose a design and method for constructing and installing a cell front panel system that simplifies the design, construction and installation of secure jail, prison, containment or detainment cell fronts. The construction design and method utilizes a steel cell front that is built of wall panels. The panels are manufactured and can be delivered to the site at a late date in the construction time frame, which allows for the building envelope to be closed in early on during the construction process. This invention allows for the panels to be pre-finished, further saving time in the overall construction process. The design of the panels is such that they can be brought into a building through standard door openings and erected with small hand tools requiring no on-site welding or the use of large cranes. All cell front connections are concealed from the cell interior making a secure facility.

BRIEF DESCRIPTION OF THE DRAWINGS

Further advantages of the invention will become apparent by reference to the detailed description of preferred embodiments when considered in conjunction with the drawings.

DETAILED DESCRIPTION

The following detailed description is presented to enable any person skilled in the art to make and use the invention. For purposes of explanation, specific details are set forth to provide a thorough understanding of the present invention. However, it will be apparent to one skilled in the art that these specific details are not required to practice the invention. Descriptions of specific applications are provided only as representative examples. Various modifications to the preferred embodiments will be readily apparent to one skilled in the art, and the general principles defined herein may be applied to other embodiments and applications without departing from the scope of the invention. The present invention is not intended to be limited to the embodiments shown, but is to be accorded the widest possible scope consistent with the principles and features disclosed herein.

Figure 1:
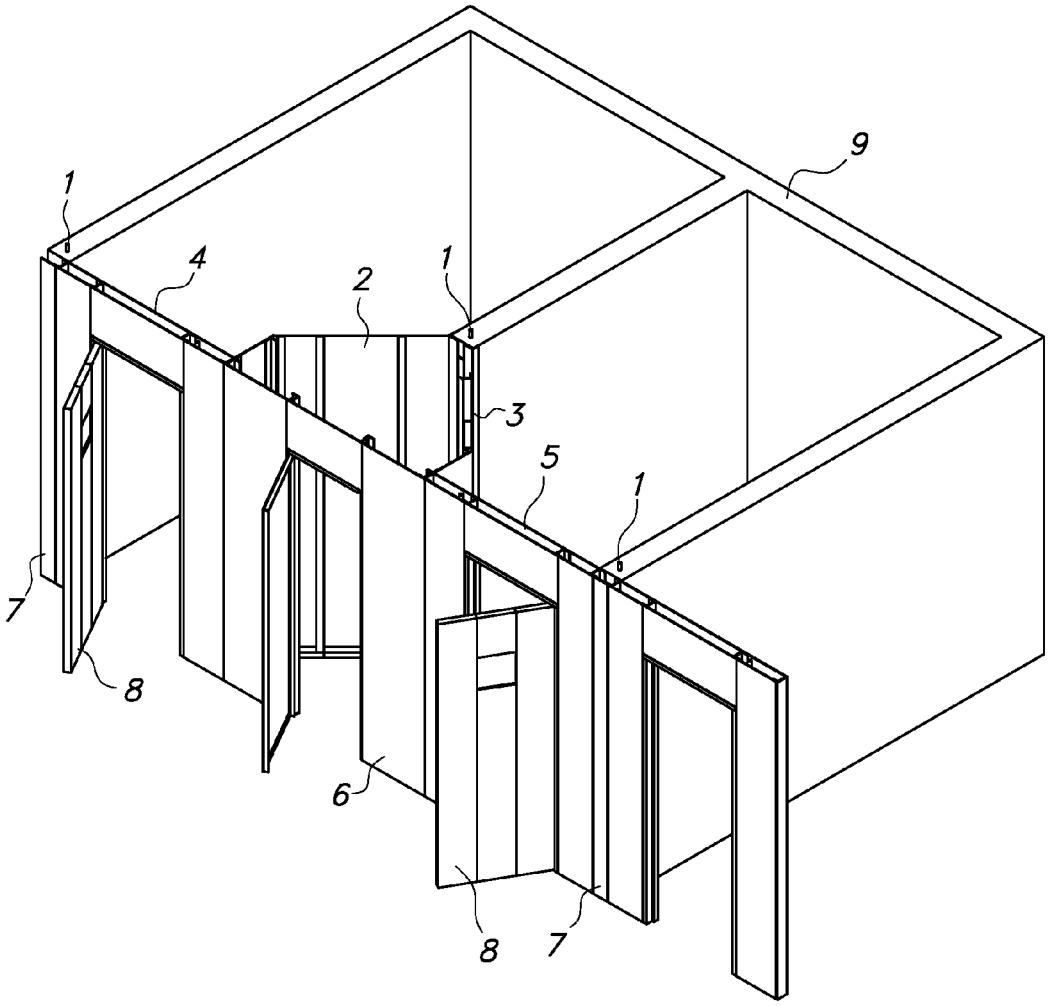
FIG. 1 is a perspective view of the cell front panel system fully installed on a masonry structure.
Figure 2:
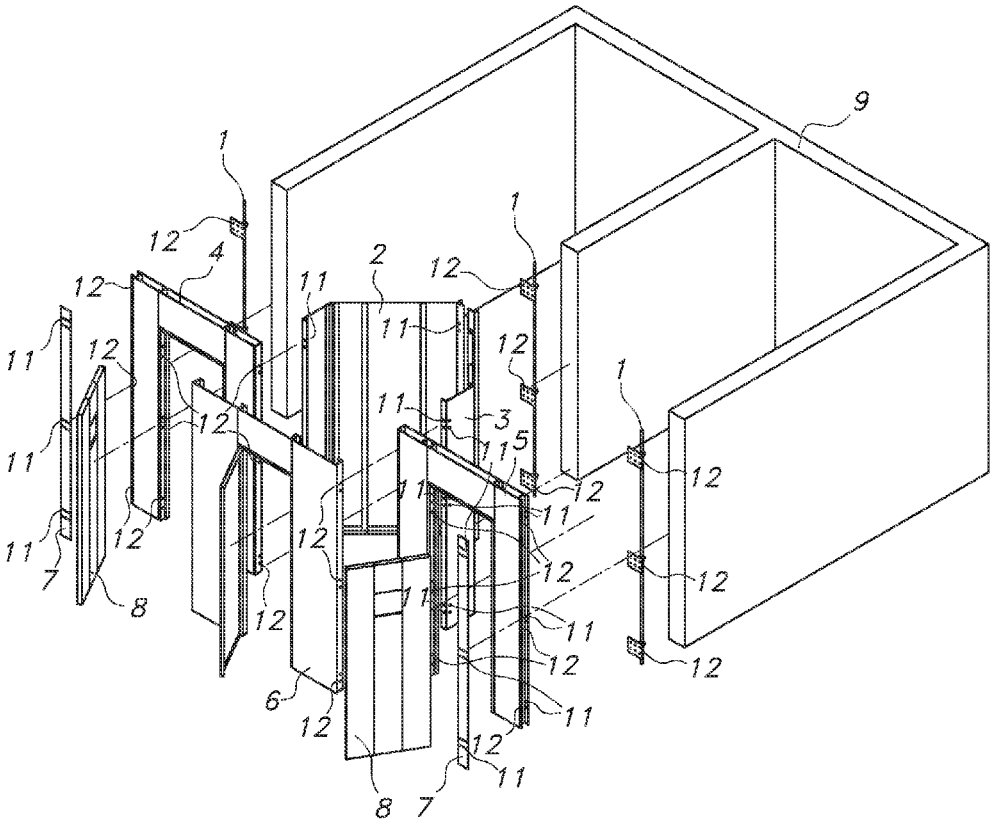
FIG. 2 is an exploded view of the cell front panel system.
Figure 3:
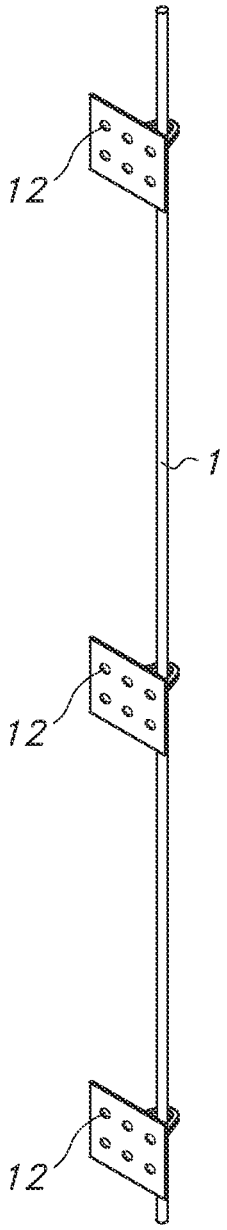
FIG. 3 is a perspective view of a wall anchor plate set.
Figure 4:
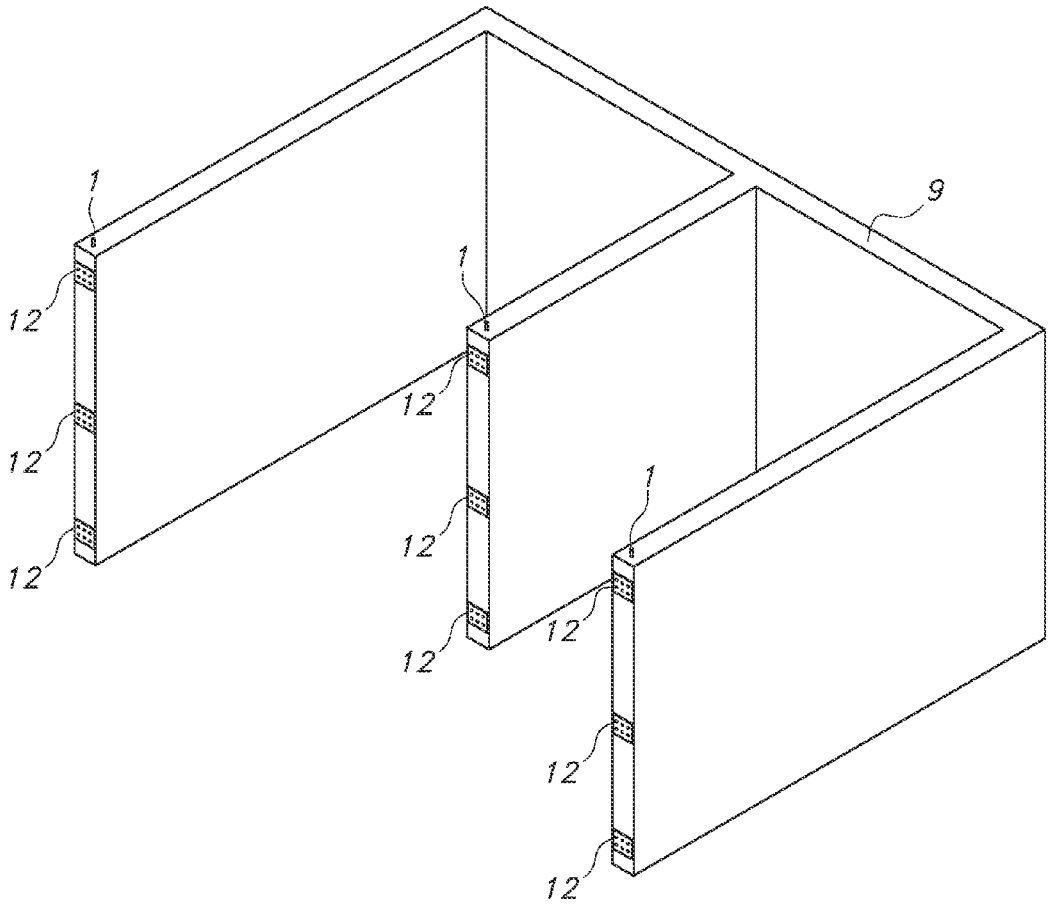
FIG. 4 is a perspective view of three wall anchor plate sets, one each installed on the left wall, center wall, and right wall of a masonry structure.
Figure 5:
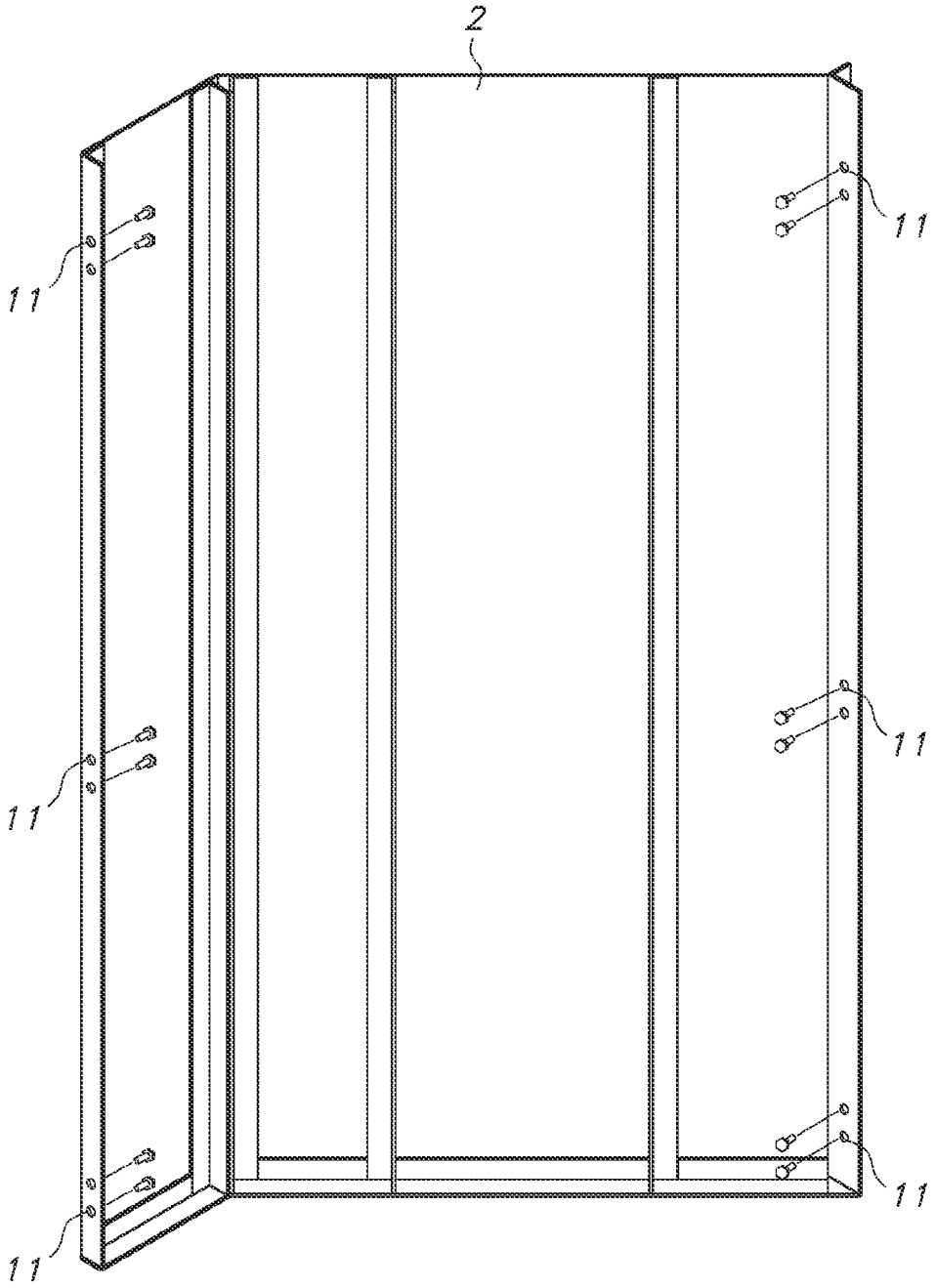
FIG. 5 is a perspective view of the chase left wall panel.
Figure 6:
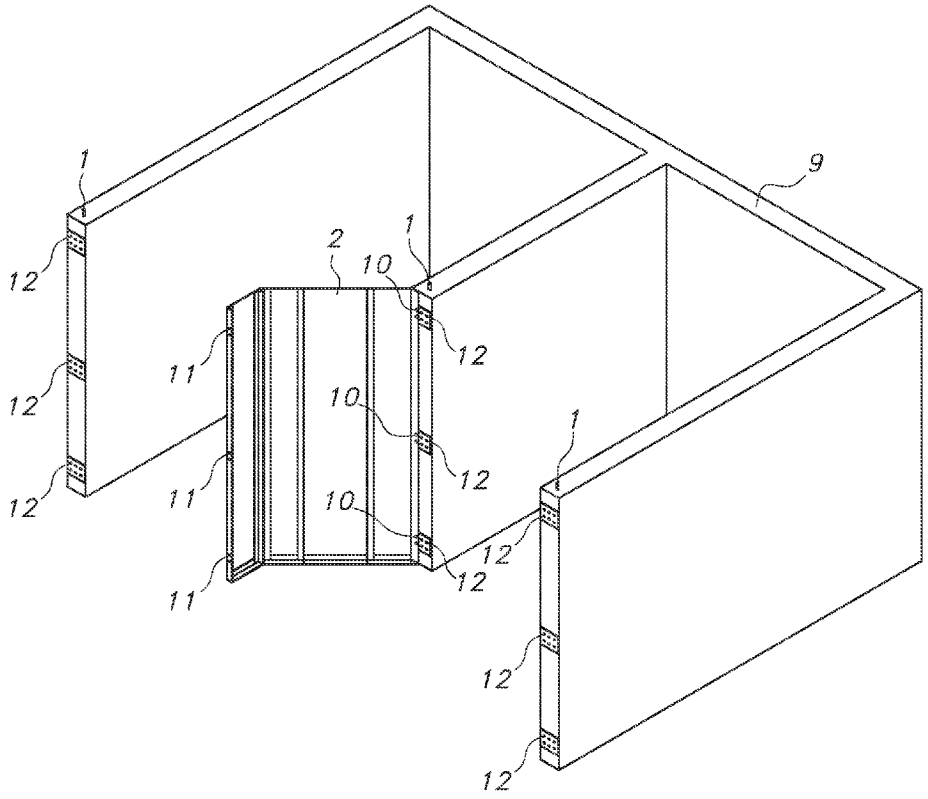
FIG. 6 is a perspective view of the chase left wall panel installed on the wall anchor plate set of the center wall of a masonry structure and anchored to the floor and ceiling on the chase side.
Figure 7:
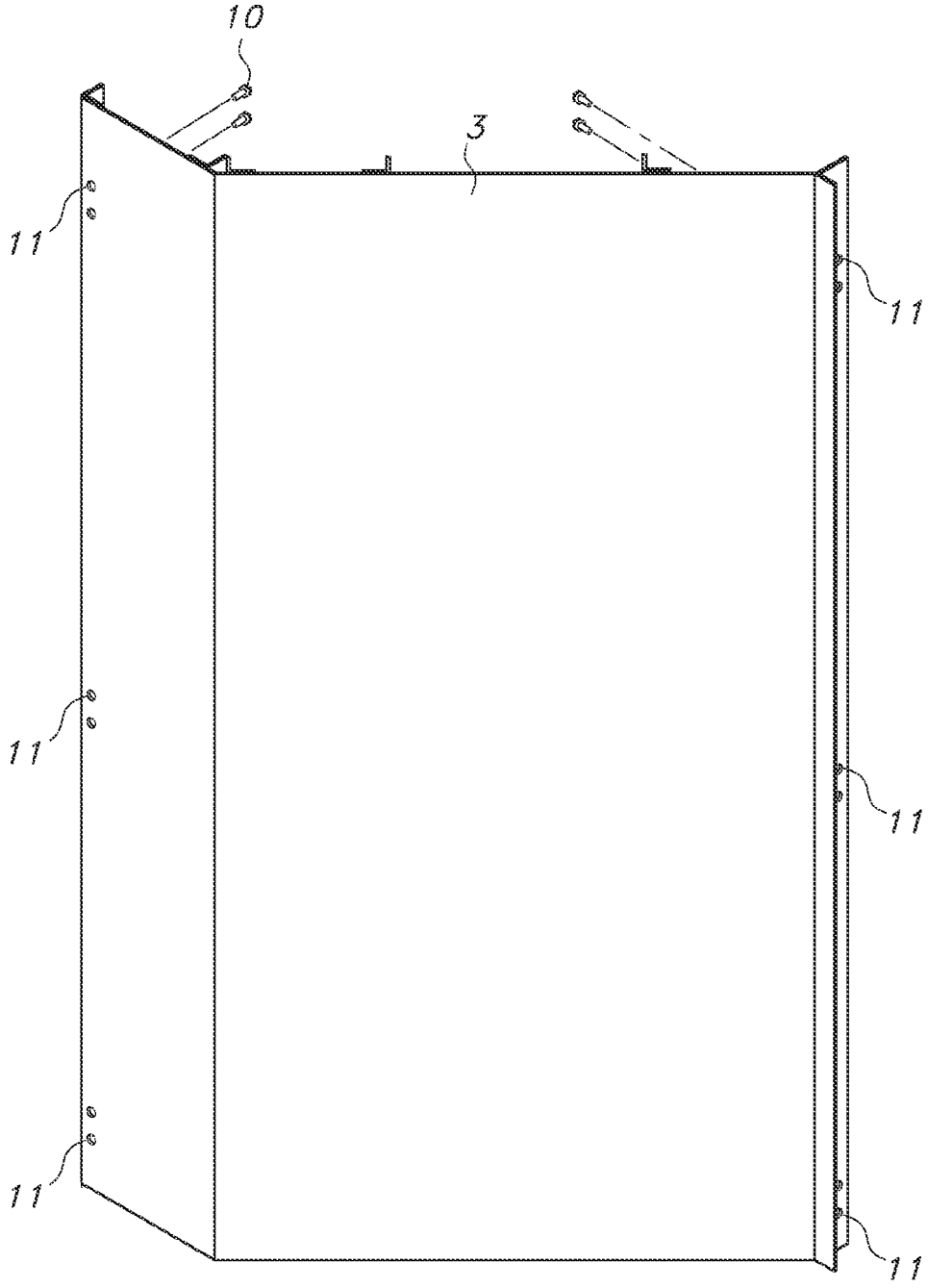
FIG. 7 is a perspective view of the chase right wall panel.
Figure 8:
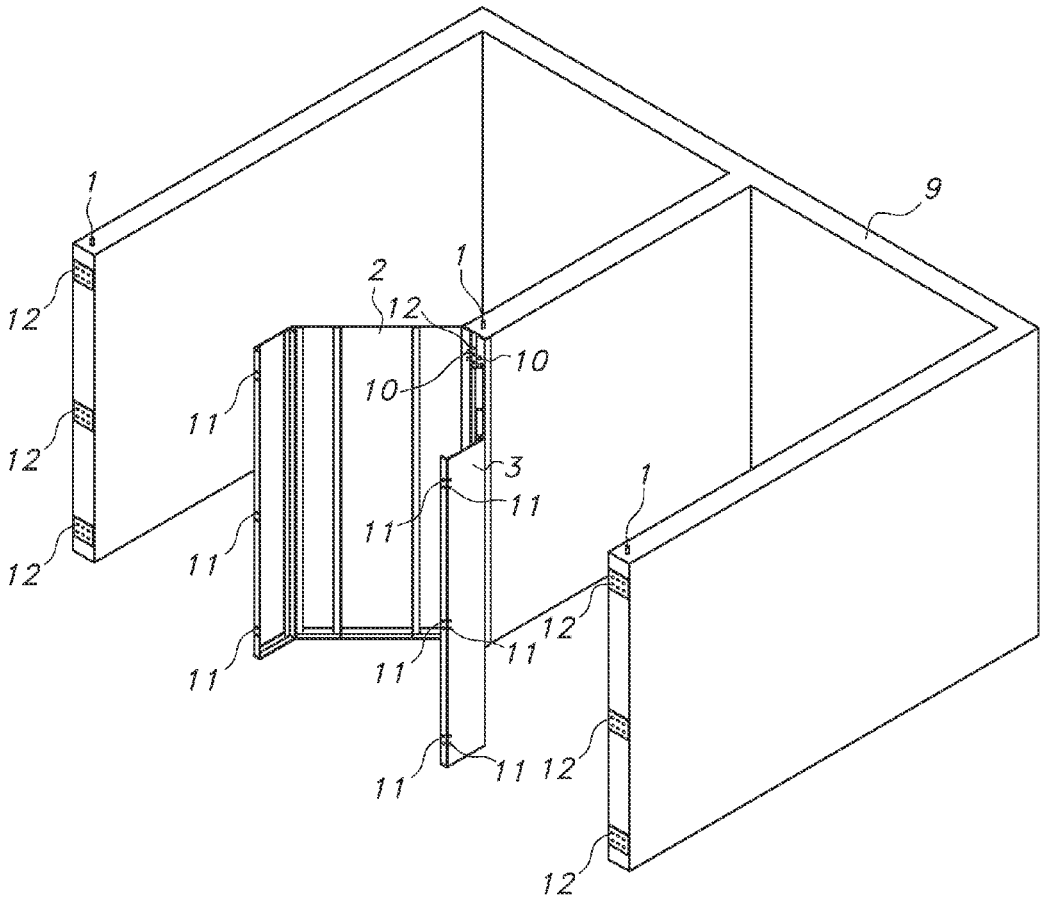
FIG. 8 is a perspective view of the chase right wall panel installed on the wall anchor plate set of the center wall of a masonry structure and anchored to the floor and ceiling on the chase side.
Figure 9:
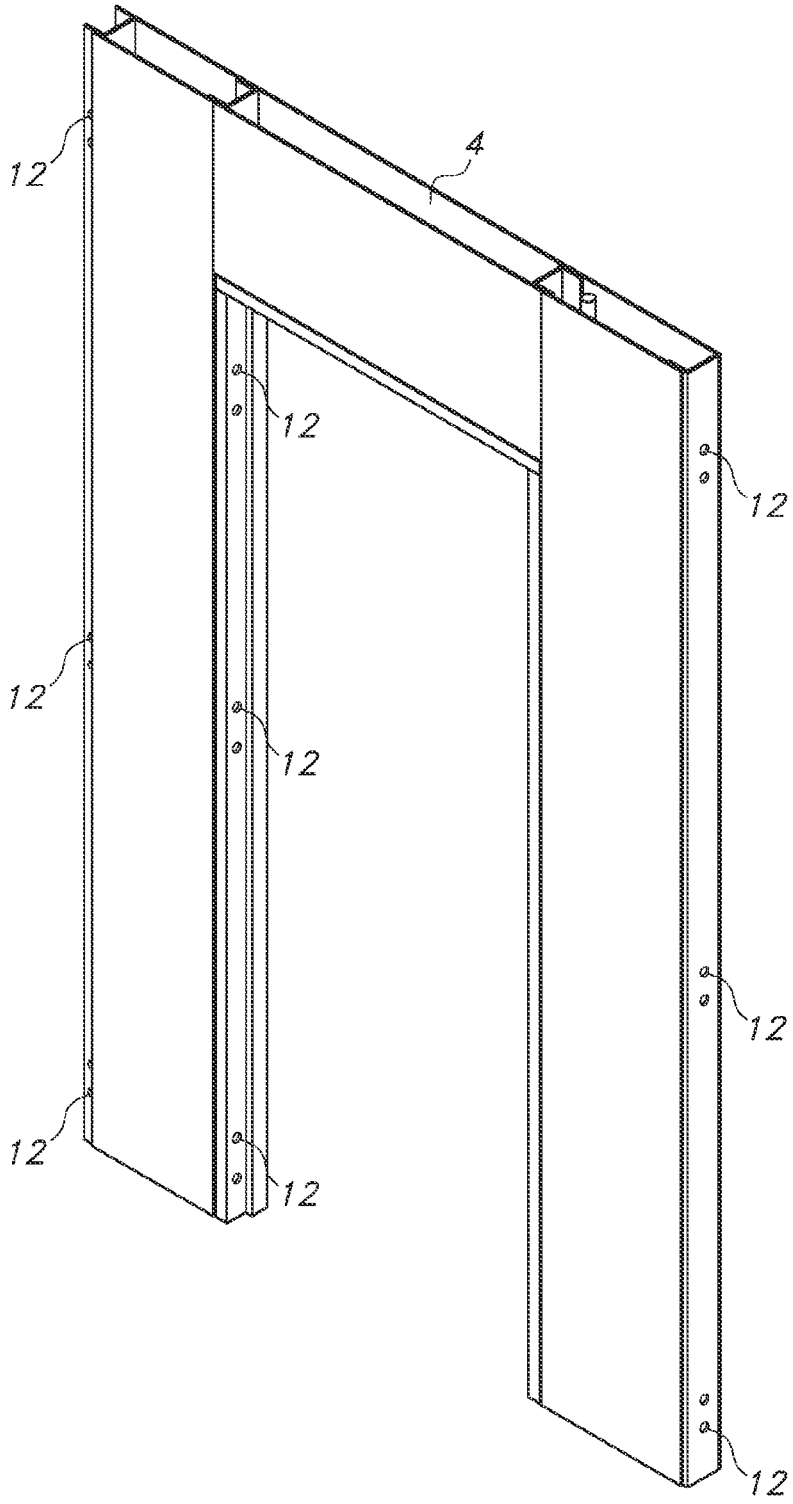
FIG. 9 is a perspective view of the left cell door panel.
Figure 10:
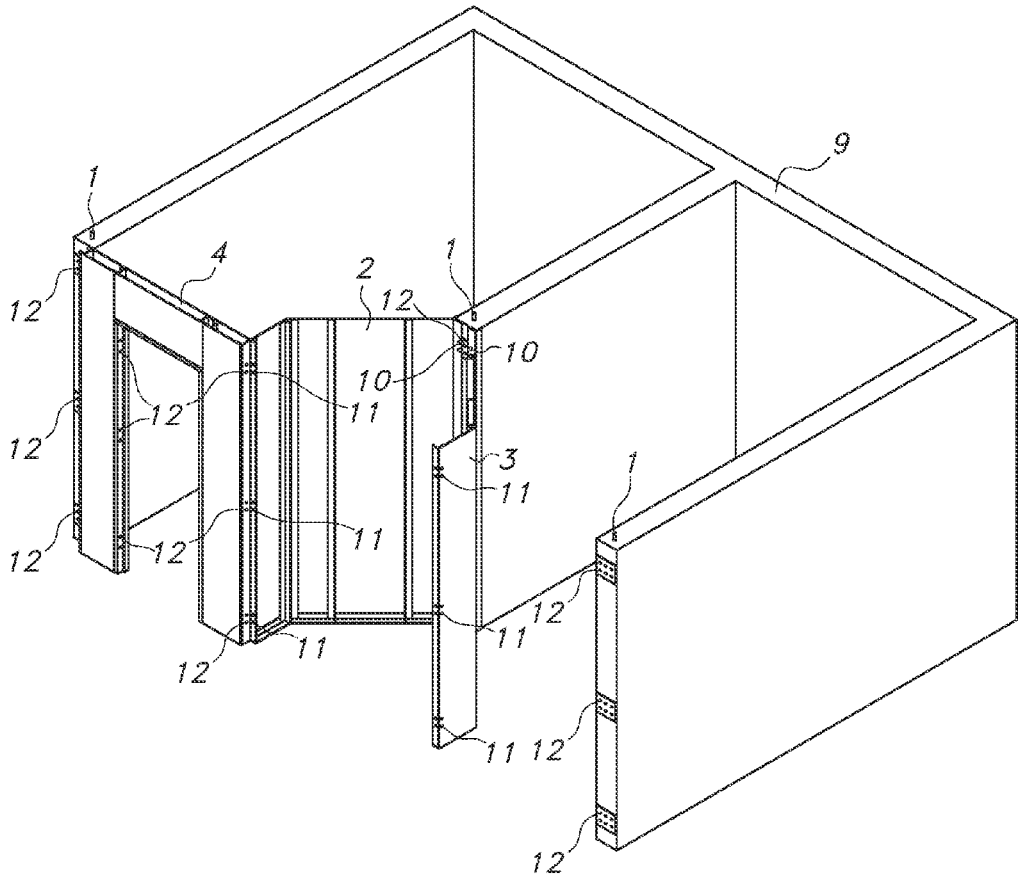
FIG. 10 is a perspective view of the left cell door panel installed on the wall anchor plate set of the left wall of a masonry structure and the chase left wall panel.
Figure 11:
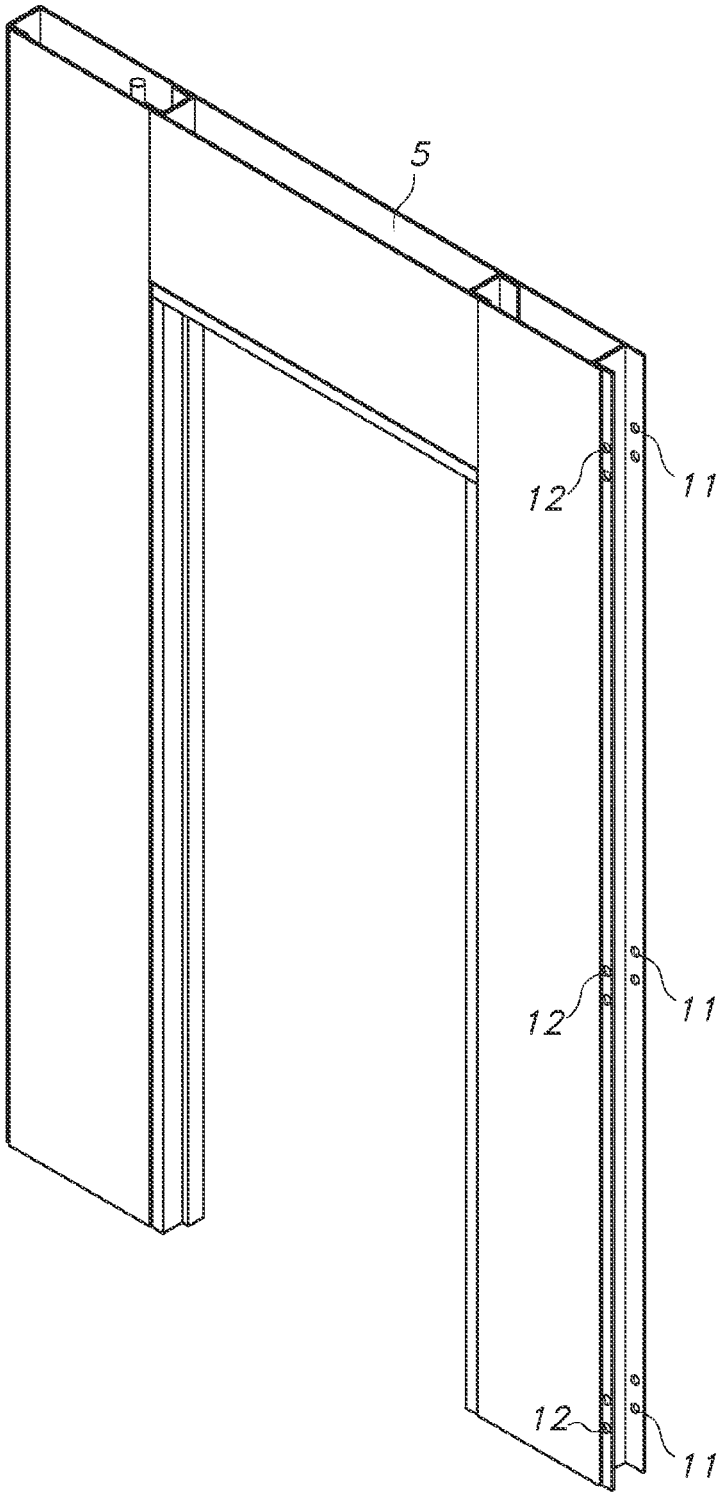
FIG. 11 is a perspective view of the right cell door panel.
Figure 12:
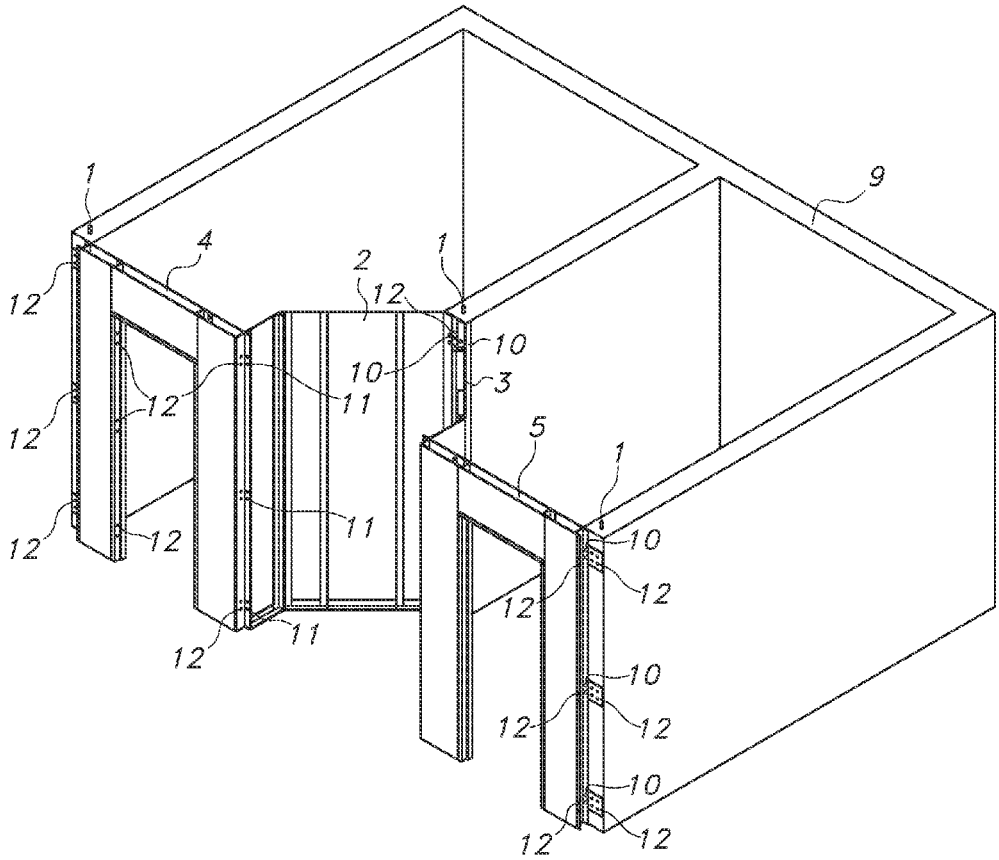
FIG. 12 is a perspective view of the right cell door panel installed on the wall anchor plate set of the right wall of a masonry structure and the chase right wall panel.
Figure 13:
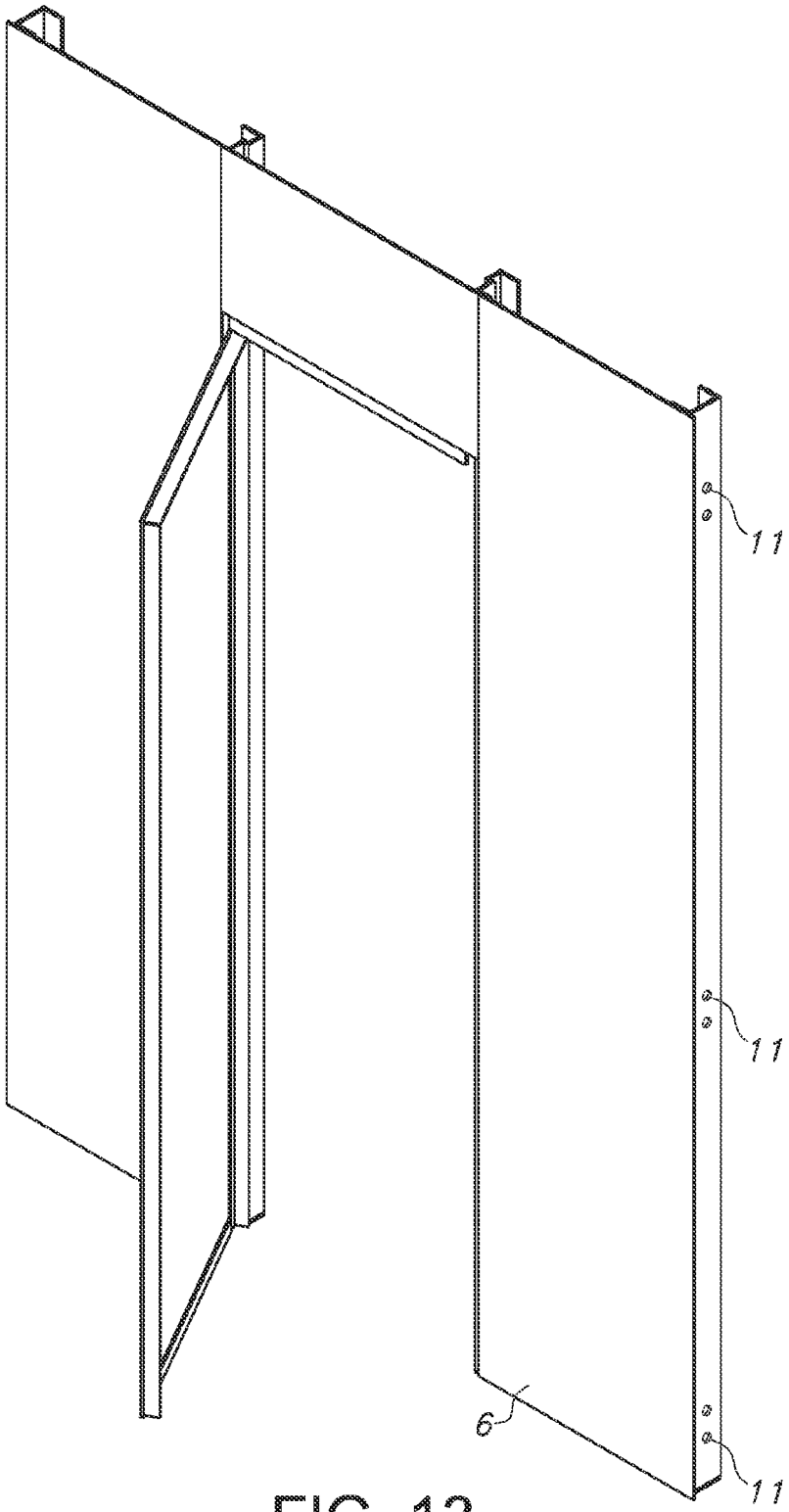
FIG. 13 is a perspective view of the chase front wall panel and door.
Figure 14:
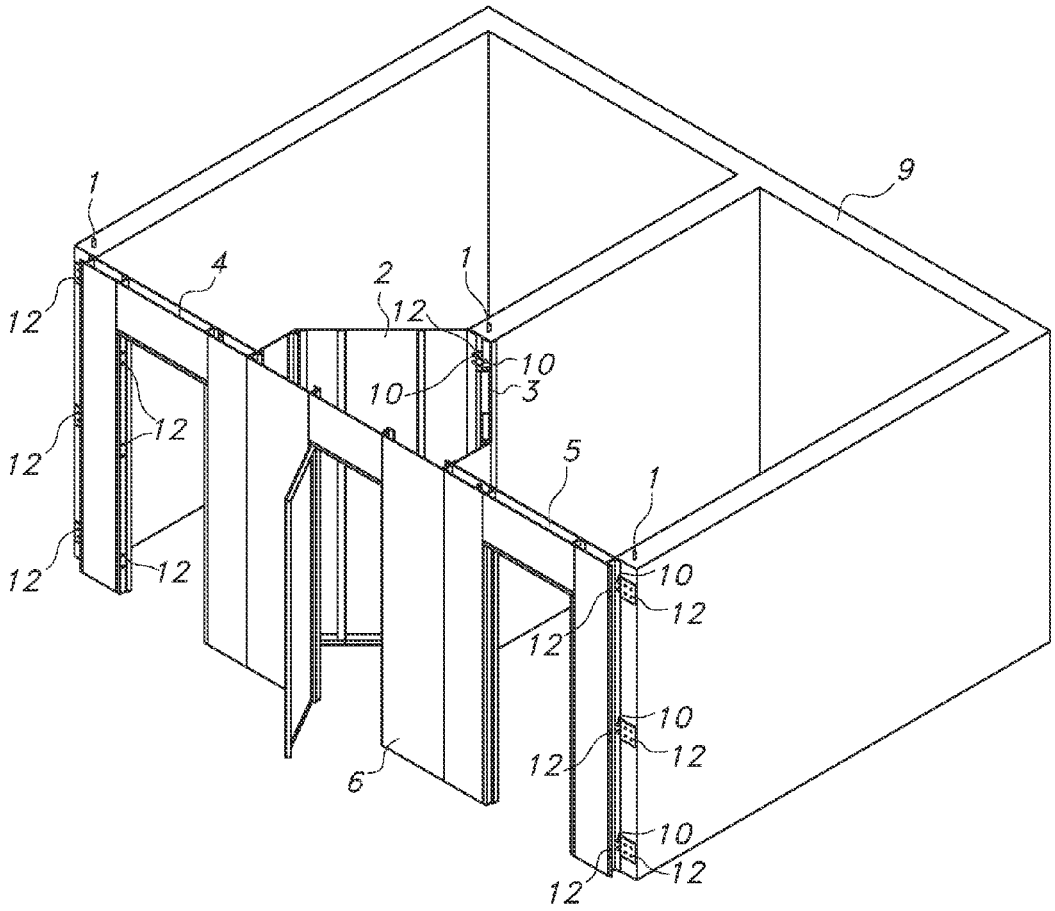
FIG. 14 is a perspective view of the chase front wall panel and door installed on the left cell door panel and the right cell door panel and anchored to the floor and ceiling on the chase side.
Figure 15:
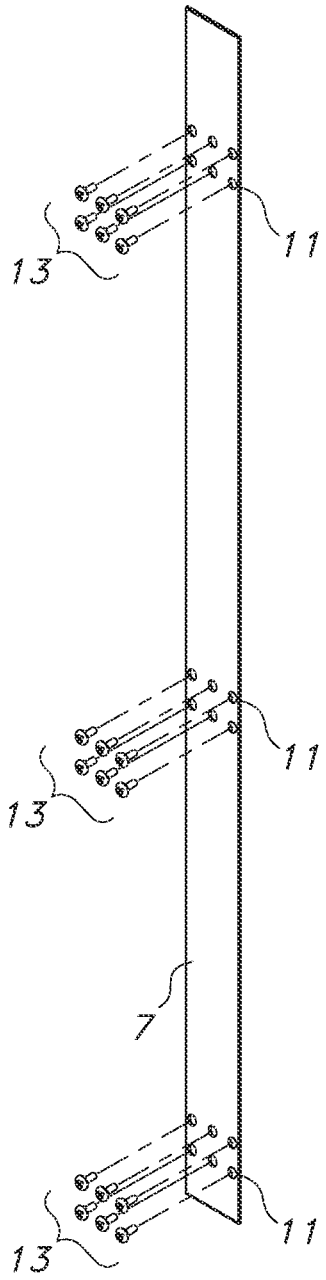
FIG. 15 is a perspective view of a closure plate.
Figure 16:
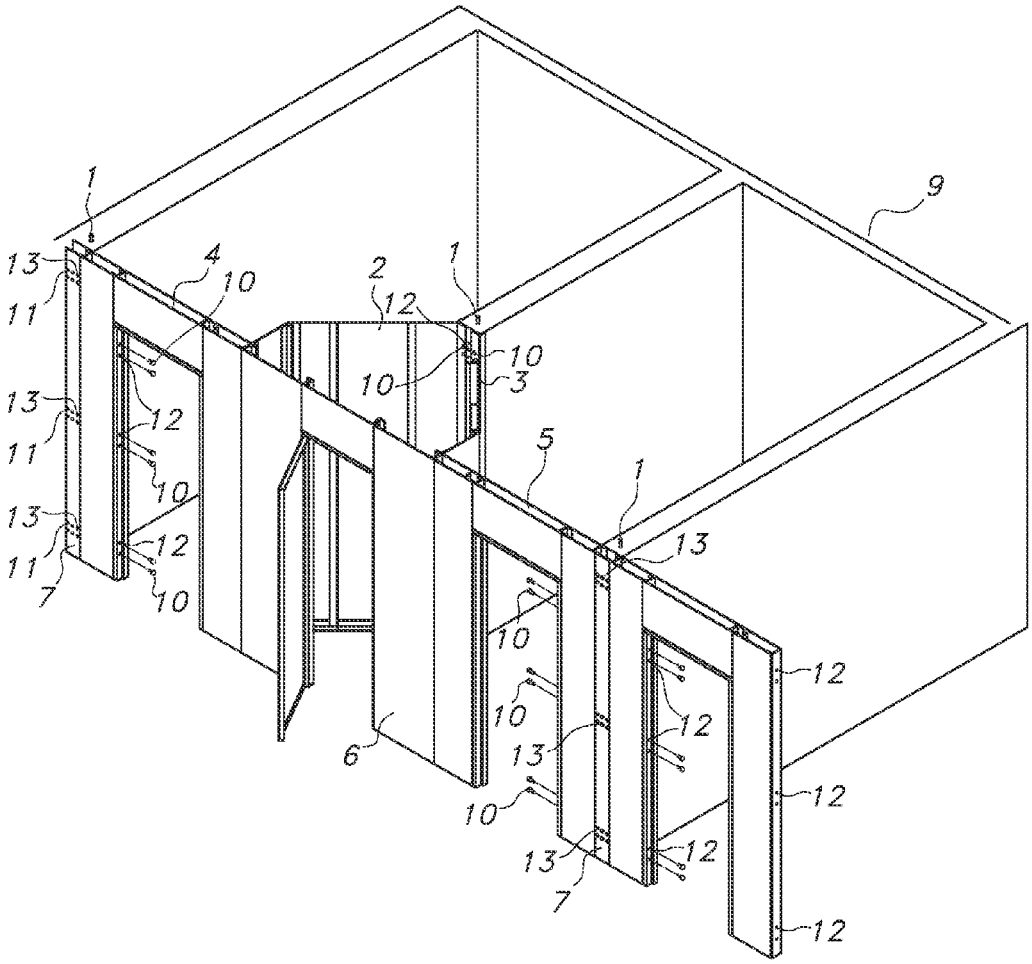
FIG. 16 is a perspective view of a closure plate installed on the wall anchor plate set of the left wall of a masonry structure and a closure plate installed on the wall anchor plate set of the right wall of a masonry structure.
Figure 17:
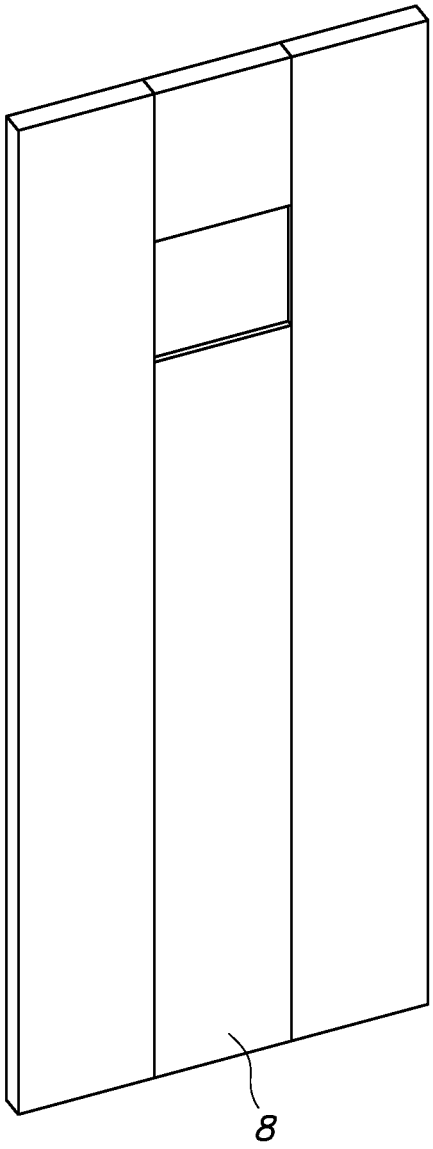
FIG. 17 is a perspective view of a cell door.
Figure 18:
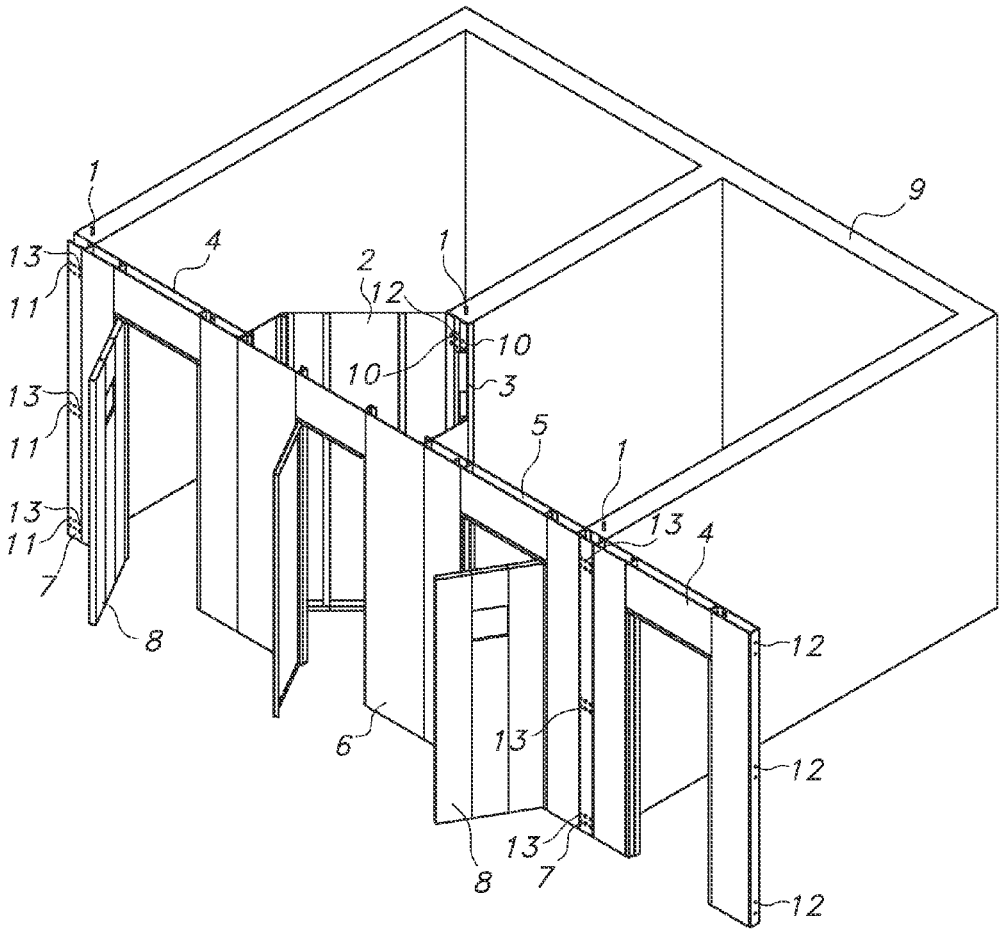
FIG. 18 is a perspective view of a cell door installed on the left cell door panel and a cell door installed on the right cell door panel.

Referring to the drawings, FIG. 1 illustrates an exemplary embodiment of the cell front panel system. The wall anchor plate sets 1 are designed to match coursing of the masonry/concrete construction and are pre-drilled and threaded to receive the chase left wall panel 2 and the chase right wall panel 3. A wall anchor plate set 1 is installed on each of the left, center and right walls of a masonry structure 9. The chase left wall panel 2 is installed by inserting bolts 10 or other fasteners or connectors through pre-drilled holes 11 in the chase left wall panel 2 into pre-drilled threaded holes 12 in the wall anchor plate set 1 of the center wall of a masonry structure 9. The chase left wall panel is also anchored to both the floor and ceiling on the chase side. The chase left wall panel 2 has pre-fabricated openings to receive attached accessories such as toilet, mirror, HVAC duct work, etc.

The chase right wall panel 3 is installed by inserting bolts 10 or other fasteners or connectors through pre-drilled holes 11 in the chase right wall panel 3 into pre-drilled threaded holes 12 in the wall anchor plate set 1 of the center wall of a masonry structure 9. The chase right wall panel 3 is also anchored to both the floor and ceiling on the chase side. The chase right wall panel 3 has pre-fabricated openings to receive attached accessories such as toilet, mirror, HVAC duct work, etc.

The left cell door panel 4 is installed by inserting bolts 10 or other fasteners or connectors through pre-drilled holes 11 in the left cell door panel 4 into pre-drilled threaded holes 12 in the wall anchor plate set 1 of the left wall of a masonry structure 9. The left cell door panel 4 is designed and equipped to receive a security door, required hardware, lock and electrical service.

The right cell door panel 5 is installed by inserting bolts 10 or other fasteners or connectors through pre-drilled holes 11 in the right cell door panel 5 into pre-drilled threaded holes 12 in the wall anchor plate set 1 of the right wall of a masonry structure 9. The right cell door panel 5 is designed and equipped to receive a security door, required hardware, lock and electrical service.

The chase front panel and door 6 is installed by inserting bolts 10 or other fasteners or connectors through pre-drilled holes 11 in the chase front panel and door 6 into pre-drilled threaded holes 12 in the left cell door panel 4 and the right cell door panel 5. The chase front panel and door 6 is also anchored to both the floor and ceiling on the chase side. The chase front panel and door 6 is equipped to receive a manual door lock.

Closure plates 7 are installed on the left and right walls of a masonry structure 9 by inserting tamper proof screws 13 or other tamper proof fasteners or connectors through pre-drilled holes 11 in the closure plates 7 into pre-drilled threaded holes 12 in the wall anchor plate sets 1 of the left and right walls of a masonry structure 9. The closure plates 7 serve as a cover to prevent access to the bolts in wall anchor plate sets 1.

The present invention is a design and method for constructing and installing a cell front panel system, which simplifies the design, construction and installation of secure jail, prison, containment or detainment cell fronts by eliminating the inherent problems with traditional prison construction methods. The terms prison, jails, containment facility and detainment facility are used interchangeably throughout and are considered for the purpose of this application to be synonymous terms.

This invention offers the industry a construction design and method utilizing a steel cell front that is built of wall panels. The panels are manufactured and can be delivered to the site at a late date in the construction time frame, which allows for the building envelope to be closed in early on in the construction process. The present invention allows for the panel surfaces to be pre-finished, further saving time in the overall construction process. The design of the panels is such that they can be brought into a building through standard door openings and erected with small hand tools requiring no on-site welding or use of large cranes. All cell front connections are concealed from the cell interior making a secure facility. This invention produces the following benefits: can be mass produced; provides for better quality control; allows for assembly line, fast track construction; eliminates time delays; requires no heavy equipment for erection; lowers shipping costs; does not interfere with other building trades; eliminates scheduling problems of being built on demand; can be used for all levels of security; can be prefinished prior to assembly; and improves overall cost control.

Prison construction is traditionally a slow process plagued with scheduling challenges and delays. Construction of the prison cell front is commonly known in the field to be a rate limiting step in the overall process because traditional methods of construction and installation required the cell front to be installed early in the construction process. In order to build a secure facility, materials such as reinforced masonry and concrete must be interfaced with items such as doors, fixtures, furnishings and hardware, which are manufactured off-site. These manufactured items are built on demand and usually have lengthy delivery times that do not coincide with on site construction schedules. For example, steel security door frames needed to be on-site prior to construction of the reinforced masonry wall that they occupy. These door frames can have a delivery time of up to 12 to 16 weeks. This type of scheduling problem mostly occurs in the construction of a prison cell front, which normally includes a security door and frame and a service chase for plumbing, mechanical and electrical fixtures.

Another example where traditional designs and methods caused construction scheduling challenges and delays involved the construction and installation of the cell front, which was done either on-site or off-site. If construction and installation was done on-site, it required welding by specialized workers. Welding is a slow and messy process that prevents the scheduling of other construction steps such as painting and finishing of the cell front surfaces. If construction of the cell front was done off-site, then it required the use of a large crane to lower and install the cell front through the roof. This method could only be done for new builds, and then must have been done early in the process before the building envelope was closed in with a roof.

An object of this invention is to simplify the construction and installation process of a secure jail, prison, containment or detainment cell front, thereby eliminating the scheduling challenges and delays inherent in the construction process of such cells.

This cell front panel system is designed to provide a secure cell front that can be manufactured on demand and off-site and not cause scheduling delays common with on-site construction. This is achieved by utilizing a series of manufactured panels that can be assembled on-site at a later date in the construction schedule. Panels can be brought into a construction facility through a standard door opening and thereafter erected in a controlled environment. The panels and other supporting components are assembled by affixing them to each other and two the masonry or concrete walls, ceiling and floor using fasteners such as bolts, screws, or rivets. The installation can therefore be done by non-specialized workers, using non-specialized hand tools. All fasteners are either tamper proof or concealed within the chase or behind closure plates to prevent all access by the inmates. The method of construction and installation is simple and occurs in a coordinated sequence that is cost effective and allows for systematic completion.

This invention eliminates the construction delays by not making masonry and concrete construction dependent on manufactured items, and also allowing for the building envelope to be closed in early since the manufactured cell front panels used in this invention are not required until late in the construction schedule. The facility contractor now has the ability to develop a critical path construction schedule that allows for a sufficient time frame for manufacturing the cell front panels and parts since installation of these panels can be installed toward the end of the construction period.

Another advantage of the ability to install this cell front later in the construction process is that the cell front will be less subject to vandalism, damage and theft, and its installation will not interfere or conflict with other disciplines or trades engaged in the construction process. The components also do not have to arrive at the site prior to construction and therefore would not be in the path of construction for other trades or disciplines.

Traditional construction methods also have inherent problems that can restrict the architect in design decisions. Designs must take into consideration the size, coursing, and tolerance of masonry units. This can affect how cells are designed and how fixtures and accessories are attached, especially with the cell front.

Another object of this invention is to provide a cell front panel system that provides the architect or designer total and unrestricted flexibility with design decisions during the design process. This invention is designed to interface with the size and coursing of masonry units and allows for adjustment to overcome the poor control of allowable tolerance in masonry construction. The manufactured panels used in this invention are pre-fabricated to receive doors, fixtures, accessories and finishes specified by the architect and his consultants. The invention permits the interfacing of the cell front with other components that have been engineered and tested lowering the risk to the design team. This invention is also designed to comply with standards established by the American Correctional Association, and the cell front can be made to meet special state, local, federal, or military needs and requirements.

Unlike traditional construction designs and methods, this invention will interface with all types of construction whether it is a new structure, an addition or renovation of an existing structure. This invention gives the architect an alternative to being limited to all on-site construction whether it is masonry, concrete, or welded in place steel plate construction. This invention also allows for different size cell dimensions, front access to plumbing, stacking of cells and the installation of cantilevered balconies. The adaptability of this invention not only allows for a more competitive bidding process, it also provides for a product that can better accommodate large projects since it can be mass produced to precision tolerances off-site.

Traditional construction designs and methods used in building prison cell fronts make for a slow and risky process. This process requires using block masons, welders, steel workers, painters and heavy equipment. Normally this process takes place in the outdoors and is dependent on weather conditions. The results can create delays, be costly and produce poor quality. This invention eliminates these risks by using a manufactured panel system that can be installed at a time when the building envelope is closed in, thereby creating a favorable construction environment. The panel system allows for field adjustments necessary to accommodate poor tolerances that occur in leveling, plumbness and dimensions, providing for improved quality, reduced cost and a timely schedule.

Finally, prison construction has one of the highest per square foot costs of all types of construction. Part of this is caused by traditional construction designs and methods requiring numerous building trades, suppliers and vendors. Coordinating and scheduling these trades, suppliers and vendors is critical in the overall success of the project. The risks associated with scheduling challenges and delays results in higher costs for the contractor to protect against over runs and potential litigation. One of the most demanding elements of prison construction is the cell front. The cell front requires building trades of masonry, concrete, steel, plumbing, mechanical, electrical and finishers. Each of these trades must coordinate their work with numerous suppliers and venders which can result in costly mistakes and delays. This invention greatly improves the scheduling process by having the cell front panel system manufactured off-site, pre-finished, and pre-fabricated to receive items that will be installed by different trades and venders at the appropriate time. This makes for a more accurate estimate of cost and schedule.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

The invention has been described with reference to various specific and preferred embodiments and techniques. However, it should be understood that many variations and modifications may be made while remaining within the spirit and scope of the invention. It will be apparent to one of ordinary skill in the art that methods, devices, device elements, materials, procedures and techniques other than those specifically described herein can be applied to the practice of the invention as broadly disclosed herein without resort to undue experimentation. All art-known functional equivalents of methods, devices, device elements, materials, procedures and techniques described herein are intended to be encompassed by this invention. Whenever a range is disclosed, all subranges and individual values are intended to be encompassed. This invention is not to be limited by the embodiments disclosed, including any shown in the drawings or exemplified in the specification, which are given by way of example and not of limitation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

I claim:

1. A cell front comprising:

a. a plurality of individual wall panels;

b. a wall anchor plate set having pre-drilled holes, wherein said wall anchor plate set is embedded in a plurality of walls such that the plurality of individual wall panels can be affixed to the wall anchor plate set in situ; and c. a means for affixing said plurality of individual wall panels to said wall anchor plate set in situ, wherein said means is selected from the group consisting of bolt, screw, and rivet.

2. The cell front of claim 1 further comprising a door.

3. The cell front of claim 1 further comprising a closure plate.

4. The cell front of claim 1 wherein said plurality of individual wall panels has pre-drilled holes.

5. The cell front of claim 1 wherein said plurality of individual wall panels has a finished surface.

6. The cell front of claim 1 wherein said wall anchor plate set has a finished surface.

7. The cell front of claim 1 wherein said plurality of individual wall panels is of a size capable of fitting through the opening of a standard door frame.

8. The cell front of claim 1 wherein access to said means is prevented from within the cell.

9. The cell front of claim 2 wherein said door has a finished surface.

10. The cell front of claim 3 wherein said closure plate has a finished surface.

11. A method for constructing and installing a cell front in situ comprising:

a. anchoring a wall anchor plate set having pre-drilled holes to a plurality of walls, wherein said anchoring includes embedding said wall anchor plate set in said plurality of walls such that a plurality of individual wall panels can be affixed to the wall anchor plate set in situ; and b. affixing said plurality of individual wall panels to said wall anchor plate set in situ using a fastener selected from the group consisting of bolt, screw, and rivet.

12. The method of claim 11 further comprising affixing a door to at least one of said plurality of individual wall panels using a fastener selected from the group consisting of bolt, screw, and rivet.

13. The method of claim 11 further comprising affixing a closure plate to at least one of said plurality of individual wall panels using a fastener selected from the group consisting of bolt, screw, and rivet.

14. The method of claim 12 wherein said panel and door fasteners are placed in locations that cannot be accessed from within the cell.

* * * * *